US011892224B2

(12) United States Patent
McAndrew

(10) Patent No.: US 11,892,224 B2
(45) Date of Patent: Feb. 6, 2024

(54) COOLING UNITS

(71) Applicant: Aerofoil Energy Limited, Cheshire (GB)

(72) Inventor: Paul McAndrew, Cheshire (GB)

(73) Assignee: Aerofoil Energy Limited, Bollington (GB)

( * ) Notice: Subject to any disclaimer, the term of this patent is extended or adjusted under 35 U.S.C. 154(b) by 574 days.

(21) Appl. No.: 16/536,852

(22) Filed: Aug. 9, 2019

(65) Prior Publication Data

US 2019/0360738 A1 Nov. 28, 2019

Related U.S. Application Data

(63) Continuation of application No. PCT/GB2018/050582, filed on Mar. 8, 2018.

(51) Int. Cl.

| | |
|---|---|
| ***F25D 17/00*** | (2006.01) |
| ***F25D 17/04*** | (2006.01) |
| ***F25D 21/04*** | (2006.01) |
| *F25D 17/06* | (2006.01) |

(52) U.S. Cl.

CPC ..... *F25D 17/045* (2013.01); *F25D 21/04* (2013.01); *F25D 17/062* (2013.01); *F25D 2300/00* (2013.01); *F25D 2321/141* (2013.01)

(58) Field of Classification Search

CPC ..... F25D 17/045; F25D 23/023; F25D 25/02; F25D 2317/063; A47F 3/0447

See application file for complete search history.

(56) References Cited

U.S. PATENT DOCUMENTS

| | | | |
|---|---|---|---|
| 2,387,622 | A | 10/1945 | Tanner |
| 2,822,672 | A | 2/1958 | Dickson |
| 3,063,252 | A | 11/1962 | Lamb |
| 3,063,253 | A | 11/1962 | Dickson et al. |
| 3,747,726 | A | 7/1973 | Walter |
| 4,265,090 | A | 5/1981 | Abraham |

(Continued)

FOREIGN PATENT DOCUMENTS

| | | | |
|---|---|---|---|
| CN | 101014268 | A | 8/2007 |
| CN | 101031225 | A | 9/2007 |

(Continued)

OTHER PUBLICATIONS

International Search Report and Written Opinion for International Application No. PCT/GB2018/050582 dated May 25, 2018, 9 pages.

(Continued)

*Primary Examiner* — Brian M King

(74) *Attorney, Agent, or Firm* — Price Heneveld LLP

(57) ABSTRACT

A cooling unit comprising: an interior space; a door separating the interior space from air external to the cooling unit, wherein the door comprises a transparent window; an air curtain system having an air egress and an air-recovery ingress, wherein the air curtain system produces an air curtain between the air egress and the air-recovery ingress, the air curtain being within the interior space and spaced from the door; and an air curtain guide for guiding flow of air within the air curtain, wherein the air curtain guide is within the interior space. A method of reducing condensation on a transparent window in a door of a cooling unit is also provided.

20 Claims, 2 Drawing Sheets

(56) References Cited

U.S. PATENT DOCUMENTS

| | | | | |
|---|---|---|---|---|
| 5,009,080 | A * | 4/1991 | Naganuma | A47F 3/0404 62/256 |
| 5,675,983 | A * | 10/1997 | Ibrahim | A47F 3/0408 62/255 |
| 5,765,388 | A * | 6/1998 | Jeon | F25D 23/023 62/408 |
| 6,094,931 | A | 8/2000 | Jeong | |
| 8,729,429 | B2 | 5/2014 | Nuttall et al. | |
| 9,370,262 | B2 | 6/2016 | Wirth | |
| D777,225 | S | 1/2017 | McAndrew | |
| D824,963 | S | 8/2018 | McAndrew | |
| D854,590 | S | 7/2019 | McAndrew | |
| 2002/0184904 | A1 | 12/2002 | Wellman | |
| 2005/0217297 | A1 | 10/2005 | Wilson | |
| 2007/0251253 | A1 | 11/2007 | Alahyari et al. | |
| 2008/0205040 | A1 | 8/2008 | Shibusawa et al. | |
| 2008/0236182 | A1 | 10/2008 | Hahn et al. | |
| 2011/0049119 | A1 | 3/2011 | Nuttall et al. | |
| 2012/0092350 | A1 | 4/2012 | Ganapathi et al. | |
| 2016/0302591 | A1 | 10/2016 | McAndrew | |
| 2017/0231403 | A1* | 8/2017 | Eget | A47F 3/0447 454/192 |
| 2018/0266254 | A1* | 9/2018 | Lee | F01D 5/186 |
| 2018/0325284 | A1 | 11/2018 | McAndrew et al. | |
| 2019/0274452 | A1 | 9/2019 | McAndrew | |
| 2021/0393052 | A1 | 12/2021 | McAndrew et al. | |

FOREIGN PATENT DOCUMENTS

| | | | | |
|---|---|---|---|---|
| CN | 102853610 | A | 1/2013 | |
| DE | 69813806 | T2 | 4/2004 | |
| EP | 0441357 | A2 | 8/1991 | |
| FR | 2690825 | A1 | 11/1993 | |
| GB | 2527636 | A | 12/2015 | |
| GB | 2541996 | A | 3/2017 | |
| JP | S5072330 | A | 6/1975 | |
| JP | S51150569 | U | 12/1976 | |
| JP | S5374768 | U | 6/1978 | |
| JP | S55165468 | A | 12/1980 | |
| JP | S57152073 | U | 9/1982 | |
| JP | S58110977 | A | 7/1983 | |
| JP | S59174588 | U | 11/1984 | |
| JP | S61196661 | U | 12/1986 | |
| JP | S62162569 | U | 10/1987 | |
| JP | H03263584 | A | 11/1991 | |
| JP | H0452481 | A | 2/1992 | |
| JP | H07248173 | A | 9/1995 | |
| JP | H10339552 | A | 12/1998 | |
| JP | 2004278865 | A | 10/2004 | |
| JP | 2010207564 | A | 9/2010 | |
| JP | 2010207565 | A | 9/2010 | |
| JP | 2011131036 | A | 7/2011 | |
| JP | 2011167384 | A | 9/2011 | |
| JP | 2012161345 | A | 8/2012 | |
| JP | 2014198069 | A | 10/2014 | |
| JP | 2017029604 | A | 2/2017 | |
| WO | WO-2012112115 | A1 | 8/2012 | |
| WO | WO-2014167320 | A1 * | 10/2014 | F25D 25/02 |

OTHER PUBLICATIONS

Office Action issued in United Kingdom Application No. GB1703813.4 dated Oct. 22, 2020, 4 pages.

Search Report for United Kingdom Application No. GB1703813.4 dated Jun. 29, 2017, 4 pages.

Office Action issued in European Application No. 18711637.1 dated Nov. 11, 2021, 5 pages.

* cited by examiner

COOLING UNITS

CROSS REFERENCE TO RELATED APPLICATIONS

This application is a continuation of International Patent Application No. PCT/GB2018/050582, filed Mar. 8, 2018, which claims priority to United Kingdom Patent Application No. 1703813.4, filed Mar. 9, 2017, the entire disclosure of each of which are hereby incorporated by reference.

FIELD

The invention relates to cooling units, such as refrigerators and freezers, and to methods of reducing condensation on a transparent window in a door of such cooling units.

BACKGROUND

Cooling units such as refrigerators and freezers are commonly used in retail environments (e.g. supermarkets and convenience stores) to store and display products, such as meat and dairy products, which must be kept at lower than ambient temperatures. Freezers in particular often have an openable door with a transparent window (e.g. a glass window), to allow customers to view the products being displayed and to retrieve products they wish to purchase from the freezer. Such doors can also be present on refrigerators (e.g. multideck refrigerators) in order to reduce energy consumption of the refrigerator.

This type of refrigerator/freezer will often have an air curtain established at the interior of the refrigerator/freezer, behind the openable door. This air curtain provides a cold air barrier which helps to maintain the interior temperature of refrigerator/freezer when the door is opened. The air curtain is established by blowing cold air from an air outlet towards an air inlet. The air inlet recovers air from the air curtain and recirculates it to the air outlet via a cooling heat exchanger and fan.

A problem with refrigerators/freezers which have openable glass doors is that condensation can form on the glass when the door is opened, giving the glass a misty appearance. This condensation/misting occurs when the inner surface of the glass (i.e. the surface facing the interior of the refrigerator/freezer when the door is closed), which is cold from being in contact with the cold air in the interior of refrigerator/freezer, meets with warmer air external to the refrigerator/freezer when the door is opened. Moisture present in the warmer air then condenses on the cold glass, which gives the glass a misty appearance and obscures the customer's view of the products in the refrigerator/freezer when the door is re-closed. Misting of the glass is exacerbated in refrigerators/freezers which have an air curtain as described above, due to the air curtain blowing against the inner surface of the glass and thus decreasing its temperature further. This increases the amount of condensation formed on the glass when the door is opened.

In some such refrigerators/freezers, heaters are used to de-mist the doors after opening. However, these heaters are costly to purchase, install and operate (as they themselves consume energy, in addition to that already consumed by the refrigerator/freezer in maintaining the temperature of the interior space), and also require maintenance.

Anti-mist coatings (sometimes referred to as anti-fog coatings) can also be applied to the glass to reduce misting of the doors, but these coatings have limited efficacy in a retail environment due to the high frequency with which the doors of refrigerators/freezers are opened by customers.

It would therefore be desirable to provide a cooling unit (for example, a refrigerator or freezer) in which the tendency of the glass doors to mist upon opening is reduced, without increasing the operating costs or the maintenance requirements of the unit.

DETAILED DESCRIPTION

Figure 1:
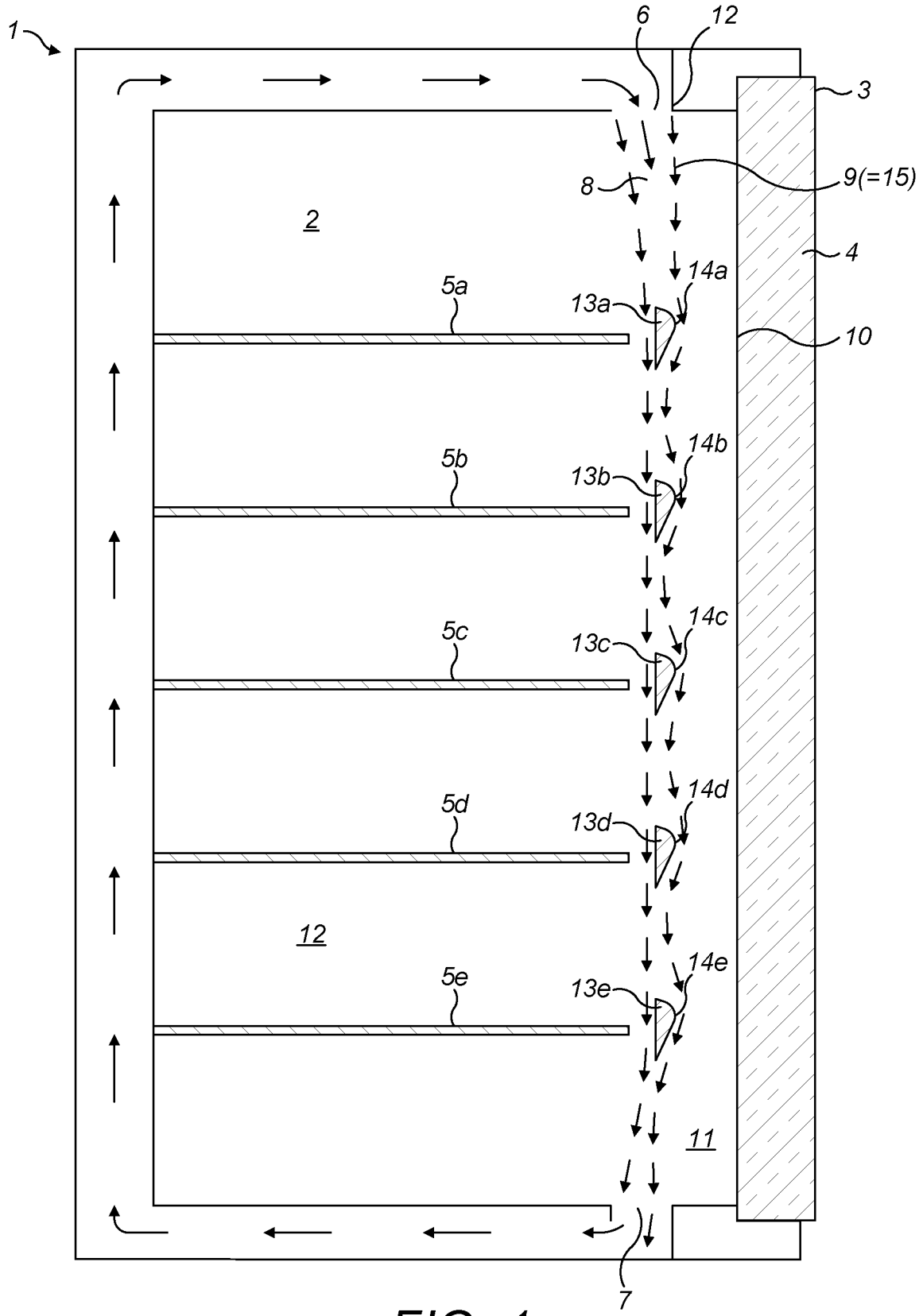
FIG. 1 shows an upright freezer according to an exemplary embodiment of the invention.

In accordance with a first aspect of the invention, there is provided a cooling unit comprising: an interior space; a door separating the interior space from air external to the cooling unit, wherein the door comprises a transparent window; an air curtain system having an air egress and an air-recovery ingress, wherein the air curtain system produces an air curtain between the air egress and the air-recovery ingress, the air curtain being within the interior space and spaced from the door; an air curtain guide for guiding flow of air within the air curtain, wherein the air curtain guide is within the interior space.

By "the air curtain being spaced from the door", it is meant that there is a gap between a front edge of the air curtain (i.e. the edge nearest the door) and an inner surface of the door (i.e. the surface of the door which faces the interior space).

By the air curtain guide "guiding flow of air in the air curtain", it is meant that the air curtain guide guides air which is moving out of a stream of the air curtain back into the stream of the air curtain, such that a gap is maintained between the front edge of the air curtain and the inner surface of the door. The cold air of the air curtain is directed away from the inner surface of the door (and held away from this inner surface), thus reducing the additional cooling effect of the air curtain on the glass. This reduces the extent of misting of the glass when the door is opened.

Typically, the air curtain is established by a fan which blows air through the air egress towards the air-recovery ingress, which recovers air from the air curtain for recirculation via a cooling unit (e.g. a heat exchanger) to the air egress. The air egress typically spans transversely across the entire width of the interior space. This ensures that the air curtain similarly spans across the entire width of the interior space.

The air curtain guide is typically aligned in a direction of air flow of the air curtain with an outer edge of the air egress, the outer edge of the air egress being an edge proximal to the door.

In one embodiment, the air curtain guide has a suction surface which faces the door. The suction surface of the air curtain guide may be aligned in a direction of air flow of the air curtain with an outer edge of the air egress, the outer edge of the air egress being an edge proximal to the door.

The interior space typically comprises an access space bounded by the door and the air curtain; and a refrigerated storage space; wherein the air curtain separates the refrigerated storage space from the access space. The air curtain guide may have a suction surface which faces the door, wherein the suction surface lies at an interface of the air curtain and the access space.

In a preferred embodiment, the air curtain guide is in the form of an aerofoil. A typical design of aerofoil that can be used is a cambered aerofoil. This will usually be oriented with the leading edge facing towards the air egress and the cambered surface (also referred to as the "suction surface" or "upper surface" of the aerofoil) facing the door.

The cooling unit typically comprises a shelf disposed in the interior space and associated with the air curtain guide. By the shelf being "associated with an air curtain guide", it is meant that the air curtain guide and the shelf are positioned relative to one another such that an inner edge of the air curtain guide (i.e. an edge furthest from the door; also referred to as a distal edge of the air curtain guide) faces a front edge of the shelf (i.e. an edge which is nearest to the door; also referred to as a proximal edge of the shelf).

Typically, the shelf has a front edge which faces the door, and the air curtain guide is spaced from the front edge of the shelf. By "spaced from the front edge of the shelf", it is meant that a gap is left between the inner edge of the air curtain guide and the front edge of the shelf.

The air curtain guide may be attached to the shelf, e.g by way of brackets. Alternatively, the air curtain guide may be attached or connected to a casing of the cooling unit via at least one connecting member (e.g. a bracket). For example, the air curtain guide may be attached via the at least one connecting member to an interior surface of the cooling unit. In any of these embodiments, the at least one connecting member (e.g. bracket) may form part of the air curtain guide.

The cooling unit may comprise a plurality of shelves. Each shelf may be associated with a respective air curtain guide.

The transparent window can be made of a glass material or a plastic material. In some embodiments, the transparent window is made of a silica glass, a poly(methyl methacrylate), a polycarbonate.

The transparent window may comprise an anti-mist coating or film on the surface of the window which faces the interior space. For example, low-emissivity (often known as "low-e") glass is coated to provide heat repellent properties and is easily commercially available from a variety of sources. Anti-fog films such as Visgard® Premium LTF-300 from FSI Coating Technologies, Inc. work in a similar way.

The term "cooling unit" as used herein is intended to encompasses both refrigerator units (also referred to as "refrigerators") and freezer units (also referred to herein as "freezers").

As used herein, the term "refrigerator" means a cooling unit in which a temperature of greater than 0° C. but less than the temperature of the air external to the refrigerator (i.e. the ambient temperature) is maintained in the refrigerated storage space.

As used herein, the term "freezer" means a cooling unit in which a temperature of 0° C. or less is maintained in the refrigerated storage space.

In some embodiments, the cooling unit is a refrigerator, for example a multideck refrigerator.

In some embodiments, the cooling unit is a freezer. The freezer may be an upright freezer, i.e. a freezer wherein the angle between the plane of the door and the horizontal plane is from 45° to 90°. An upright freezer typically contains one or more shelves for display of products. Alternatively, the freezer may be a chest freezer, i.e. a freezer wherein the angle between the plane of the door and the horizontal plane is from 0° to less than 45°. In a chest freezer, products are typically stacked on top of one another from the freezer floor upwards, or are placed in baskets which extend vertically downwards towards the floor of the freezer.

In accordance with a second aspect of the invention, there is provided a method of reducing condensation on a transparent window in a door of a cooling unit, the cooling unit having an air curtain system which produces an air curtain between an air egress and an air-recovery ingress in an interior space of the cooling unit, the method comprising disposing an air curtain guide in the interior space for guiding flow of air within the air curtain.

As previously discussed, by the air curtain guide "guiding flow of air in the air curtain", it is meant that the air curtain guide guides air which is moving out of a stream of the air curtain back into the stream of the air curtain, such that a gap is maintained between a front edge of the air curtain and an inner surface of the door. The cold air of the air curtain is directed away from the inner surface of the door (and held away from this inner surface), thus reducing the additional cooling effect of the air curtain on the glass. This reduces the extent of misting of the glass when the door is opened.

Again, the air curtain is typically established by a fan which blows air through the air egress towards the air-recovery ingress, which recovers air from the air curtain for recirculation via a cooling unit (e.g. a heat exchanger) to the air egress. The air egress typically spans transversely across the entire width of the interior space. This ensures that the air curtain similarly spans across the entire width of the interior space.

The method may further comprise aligning the air curtain guide in a direction of air flow of the air curtain with an outer edge of the air egress, the outer edge of the air egress being an edge proximal to the door.

The method may comprise disposing the air curtain guide in the interior space such that a suction surface of the air curtain guide faces the door. The method may further comprise aligning the suction surface of the air curtain guide in a direction of air flow of the air curtain with an outer edge of the air egress, the outer edge of the air egress being an edge proximal to the door.

The method may comprise disposing the air curtain guide in the interior space such that a suction surface of the air curtain guide lies at an interface of the air curtain and an access space of the cooling unit, the access space being an area of the interior space which is bounded by the door and the air curtain.

In a preferred embodiment, the air curtain guide is in the form of an aerofoil. A typical design of aerofoil that can be used is a cambered aerofoil. This will usually be oriented with the leading edge facing towards the air egress and the cambered surface (also referred to as the "suction surface" or "upper surface" of the aerofoil) facing the door.

The method may comprise associating the air curtain guide with a shelf of the cooling unit, for example a shelf which is disposed in the interior space of the cooling unit. By "associating the air curtain guide with a shelf", it is meant that the air curtain guide is positioned such that an inner edge of the air curtain guide (i.e. an edge furthest from the door; also referred to as a distal edge of the air curtain guide) faces a front edge of the shelf (i.e. an edge which is nearest to the door; also referred to as a proximal edge of the shelf).

Typically, the shelf has a front edge which faces the door, and the air curtain guide is spaced from the front edge of the shelf. By "spaced from the front edge of the shelf", it is meant that a gap is left between the inner edge of the air curtain guide and the front edge of the shelf.

The method may comprise attaching the air curtain guide to the shelf, e.g by way of brackets. Alternatively, the method may comprise attaching or connecting the air curtain guide to a casing of the cooling unit via at least one connecting member (e.g. a bracket). For example, the air curtain guide may be attached via the at least one connecting member to an interior surface of the cooling unit. In any of these embodiments, the at least one connecting member (e.g. bracket) may form part of the air curtain guide.

The term "cooling unit" as used herein is intended to encompass both refrigerator units (also referred to as "refrigerators") and freezer units (also referred to herein as "freezers").

As used herein, the term "refrigerator" means a cooling unit in which a temperature of greater than 0° C. but less than the temperature of the air external to the refrigerator (i.e. the ambient temperature) is maintained in the refrigerated storage space.

As used herein, the term "freezer" means a cooling unit in which a temperature of 0° C. or less is maintained in the refrigerated storage space.

In some embodiments, the cooling unit is a refrigerator, for example a multideck refrigerator.

In some embodiments, the cooling unit is a freezer. The freezer may be an upright freezer, i.e. a freezer wherein the angle between the plane of the door and the horizontal plane is from 45° to 90°. An upright freezer typically contains one or more shelves for display of products. Alternatively, the freezer may be a chest freezer, i.e. a freezer wherein the angle between the plane of the door and the horizontal plane is from 0° to less than 45°. In a chest freezer, products are typically stacked on top of one another from the freezer floor upwards, or are placed in baskets which extend vertically downwards towards the floor of the freezer.

FIG. 1 shows a cross-section through an upright freezer 1. The freezer has an interior space 2 and a door 3 separating the interior space 2 from air external to the freezer 1. The door 3 comprises a transparent window 4. Within the interior space 2, there are five shelves 5*a*-5*e*. The freezer 1 comprises an air curtain system having an air egress 6 and an air recovery inlet 7. The air curtain system establishes an air curtain 8 within the interior space 2 of the freezer 1 by blowing cold air from air egress 6 towards air recovery ingress 7. Air recovery ingress 7 recovers air from the air curtain 8 and a fan (not shown) within the freezer 1 recirculates the air to the air egress 6 via a cooling heat exchanger (not shown) within the freezer 1 which maintains the recirculated air (and hence the air blown through the air egress 6 to form the air curtain 8) at a desired temperature. As can be seen from FIG. 1, the air curtain 8 is spaced from the door 3, i.e. there is a gap between a front edge 9 of the air curtain 8 (i.e. the edge nearest the door 3) and an inner surface 10 of the door 3 (i.e. the surface of the door which faces the interior space 2). The interior space 2 thus comprises an access space 11 which is bounded by the door 3 (specifically, the inner surface 10 of the door 3) and the air curtain 8 (specifically, the front edge 9 of the air curtain 8), and a refrigerated storage space 12. The refrigerated storage space 12 is separated from the access space 11 by the air curtain.

Also shown in FIG. 1 are aerofoils 13*a*-13*e*, each of which is fitted to the front edge of a respective one of shelves 5*a*-5*e* by way of brackets (not shown).

In the embodiment illustrated in FIG. 1, the air curtain 8 runs vertically from the air egress 6 to the air recovery ingress 7. The aerofoils 13*a*-13*e* are aligned in a direction of air flow of the air curtain 8 with an outer edge 12 of the air egress 6. In this embodiment, each aerofoil 13*a*-13*e* has a respective suction surface 14*a*-14*e* which faces the door 3. The suction surface 14*a*-14*e* of each aerofoil 13*a*-13*e* lies at an interface 15 of the air curtain 8 and the access space 11 (i.e. the suction surface 14*a*-14*e* of each aerofoil 13*a*-13*e* lies on the front edge 9 of the air curtain 8).

Figure 2:
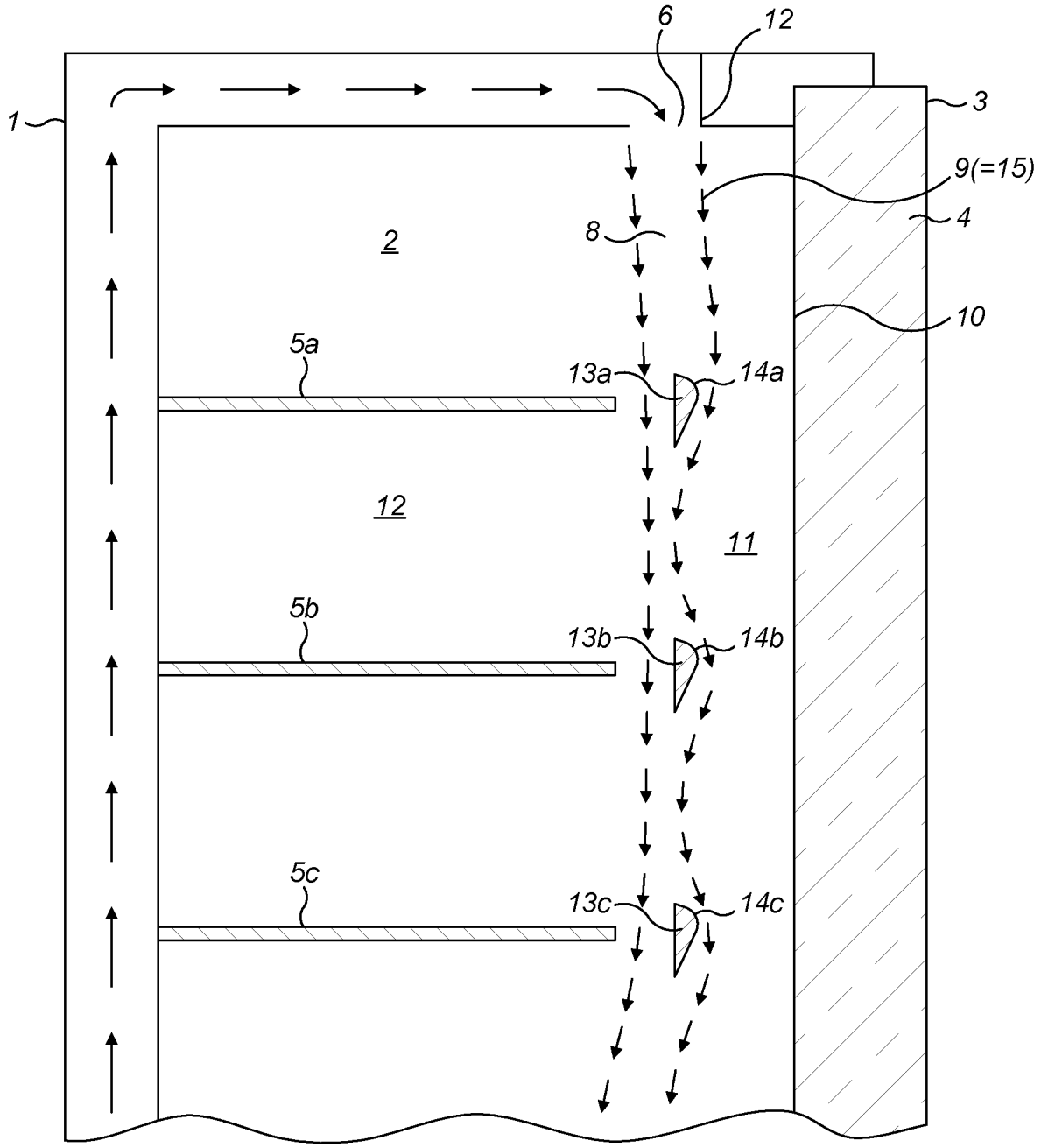
FIG. 2 is an enlarged view of a portion of FIG. 1, in which the flow of air within the air curtain around the aerofoils is shown schematically.

A shown in FIG. 1, and more clearly in FIG. 2, the aerofoils 13*a*-13*e* act to direct the cold air of the air curtain 8 away from the inner surface 10 of the door 3, and constrain it in the desired path. This reduces the additional cooling effect of the air curtain 8 on the glass, and thus reduces the extent of misting of the glass when the door 3 is opened.

The invention claimed is:

1. A cooling unit comprising:

an interior space;

a door separating the interior space from air external to the cooling unit, wherein the door comprises a transparent window having an uppermost edge, a lowermost edge and an inner surface facing the interior space;

a plurality of shelves disposed within the interior space, each shelf of the plurality of shelves including a front edge that faces the door;

an air curtain system having an air egress and an air-recovery ingres;

an air curtain produced by the air curtain system between the air egress and the air-recovery ingress, the air curtain being within the interior space, and wherein the air curtain is spaced from the inner surface of the window by an access space that extends along an entire length of the window between the uppermost edge and the lowermost edge; and a plurality of air curtain guides each including an airfoil positioned between and spaced from the front edge of a respective shelf of the plurality of shelves and the inner surface of the window, wherein each airfoil is configured to direct the flow of air within the air curtain away from the door when the door is in a closed position such that misting of the transparent window is reduced by reducing a cooling effect on the door.

2. The cooling unit of claim 1, wherein each air curtain guide is aligned in a direction of air flow of the air curtain with an outer edge of the air egress, the outer edge of the air egress being an edge proximal to the door.

3. The cooling unit of claim 1, wherein each air curtain guide has a suction surface which faces the door.

4. The cooling unit of claim 3, wherein the suction surface of each air curtain guide is aligned in a direction of air flow of the air curtain with an outer edge of the air egress, the outer edge of the air egress being an edge proximal to the door.

5. The cooling unit of claim 1, wherein the interior space includes a refrigerated storage space, the air curtain separating the refrigerated storage space from the access space.

6. The cooling unit of claim 5, wherein each air curtain guide has a suction surface which faces the door, and the suction surface of each air curtain guide lies proximate an interface of the air curtain and the access space.

7. The cooling unit of claim 1, wherein each air curtain guide is attached to one of the shelves of the plurality of shelves.

8. The cooling unit of claim 7, wherein each air curtain guide is attached to the one of the shelves of the plurality of shelves by way of brackets.

9. The cooling unit of claim 1, wherein the transparent window comprises an anti-mist coating or film on the inner surface of the transparent window.

10. The apparatus of claim 1, wherein the airfoil includes a cambered surface.

11. An apparatus, comprising:

a transparent window in a door of a cooling unit, where the door is moveable between an open position and a closed position;

a shelf positioned within an interior space of the cooling unit and including a front edge that faces the door;

an air curtain system of the cooling unit;

an air curtain produced by the air curtain system between an air egress and an air-recovery ingress of the air curtain system in the interior space of the cooling unit, wherein the air curtain extends along an entire length of the window; and an air curtain guide located between the front edge of the shelf and the window and spaced from the front edge of the shelf, wherein the air curtain guide is configured to guide flow of air within the air curtain such that the air curtain is spaced from the window of the door by an access space that extends along the entire length of the window when the door is in the closed position.

12. The apparatus of claim 11, wherein the air curtain guide is aligned in a direction of air flow of the air curtain with an outer edge of the air egress, the outer edge of the air egress being an edge proximal to the door.

13. The apparatus of claim 11, wherein the air curtain guide is disposed in the interior space such that a suction surface of the air curtain guide faces the door.

14. The apparatus of claim 13, the suction surface of the air curtain guide is aligned in a direction of air flow of the air curtain with an outer edge of the air egress, the outer edge of the air egress being an edge proximal to the door.

15. The apparatus of claim 11 wherein the air curtain guide is disposed in the interior space such that a suction surface of the air curtain guide lies proximate an interface of the air curtain and the access space.

16. The apparatus of claim 11, wherein the air curtain guide includes an airfoil.

17. The apparatus of claim 11, wherein the air curtain guide is attached to the shelf.

18. The apparatus of claim 16, wherein the airfoil includes a cambered surface.

19. The apparatus of claim 16, wherein the airfoil is an asymmetrical airfoil.

20. The apparatus of claim 11, wherein the door extends in a substantially vertical direction.

* * * * *